United States Patent [19]

Kunimoto et al.

[11] 4,395,446

[45] Jul. 26, 1983

[54] PEELABLE ADHESIVE STRUCTURE

[75] Inventors: Go Kunimoto, Chigasaki; Isao Ichinose, Hiratsuka; Noboru Suzuki, Fujisawa; Fumio Mori, Yokohama, all of Japan

[73] Assignee: Toyo Seikan Kaisha, Ltd., Tokyo, Japan

[21] Appl. No.: 360,368

[22] Filed: Mar. 22, 1982

Related U.S. Application Data

[63] Continuation of Ser. No. 94,570, Nov. 15, 1979, abandoned.

[30] Foreign Application Priority Data

Nov. 17, 1978 [JP] Japan ..... 53-141065

[51] Int. Cl.[3] ..... B32B 15/08

[52] U.S. Cl. ..... 428/35; 428/172; 428/352; 428/416; 428/418; 428/461; 428/500

[58] Field of Search ..... 428/461, 35, 172, 352, 428/416, 418, 500

[56] References Cited

U.S. PATENT DOCUMENTS 4,132,857 1/1979 Scarola ..... 428/461

4,136,615 1/1979 Pozniak ..... 428/461

*Primary Examiner*—Marion McCamish

[57] ABSTRACT

A peelable adhesive structure is disclosed which comprises a plurality of parts at least one of which is made of metal, adhering together by means of a coating, characterized in that said coating has a peelable surface formed between a first layer of a denatured hydrocarbon resin or denatured hydrocarbon resin composition having an acid value of from 0.1 to 20 and a second layer containing an epoxy resin.

10 Claims, 3 Drawing Figures

PEELABLE ADHESIVE STRUCTURE

This is a continuation, of application Ser. No. 094,570, filed Nov. 15, 1979, now abandoned.

DESCRIPTION

1. Technical Field

The present invention relates to peelable adhesive structures. More particularly it relates to a structure comprising two parts, at least one of which is made of metal, peelably bonded together through a novel multilayer coposite coating.

2. Background Art

Heretofore, adhesive structures having pairs of parts peelably bonded together have been used in a variety of fields, particularly in the packaging art involving containers, caps and seals.

For example, a crown or other conventional container cap is normally made from a piece of sheet metal, to the surface of which a protective paint has been applied, and formed into the shape of a crown shell or cap shell, with a packing adhered to the inside of the formed shell.

In the prize marketing of bottled beverages, the common procedure is to award a prize in exchange for a predetermined number of packings or a winning packing submitted by a consumer or buyer. For such purposes, it is necessary for the crown caps to have a packing which is easily peelable from the cap shell. On the other hand, in the process of manufacturing caps, and bottling and shipment, it is necessary for the packing to adhere with sufficient tenacity to the cap shell so that it will not separate prematurely. In addition, the cap shell must be resistant to corrosion by the contents of the container and have a sufficient structural integrity to withstand the steps of climbing and roll-on during bottling. Moreover, since it is impossible from the standpoint of hygienics to print on the packing surface that come in direct contact with the container's contents, and since the packing itself is applied to the cap shell in the form of a fluid, it is desirable that the ink layer provided on the inside of the cap shell be removed together with the packing when the packing is peeled off.

Such a peelable adhesive structure is usable for canned goods containers having an opening device such as the so-called easy open or "flip top" mechanism. For example, the well-known easy open mechanism comprises a can end member made of metal on which a surface protective coating is applied, one or more openings provided on the end member for removing the contents and a peelable cover or "tab" for the opening made of metal foil or sheet coated with an organic resin. In such an easy-open end, it is also important to have excellent adhesion and sealing between the can end member and the peelable tab during storage of the contents. On the other hand, the peelable tab must be easily separable from the end member on demand when peeled off.

It is known to provide a plurality of coatings on a metal sheet used to form a cap shell, and to adhere a packing made of synthetic resin on the coatings so that the packing can be peeled off with separation occurring in a plane between the coatings. To impart peelability to the coatings, it has been disclosed that a hydrocarbon resin such as petroleum resin can be added to at least one of the coatings. However, since such resin has a lower activity and reactivity than other resins, the coating containing the hydrocarbon has such poor wettability that it is difficult to apply it over another coating. Moreover, since the hydrocarbon resin has little adhesiveness to other resin coatings and poor dispersibility in a coating base resin, it is difficult to provide the desired "peelable adhesion" with good reproducibility between both coatings, i.e., such that the packing will not come off in normal handling but when peeled, the coatings are peeled off without causing cohesive breakage of the packing and coatings. Furthermore, the paint, having a tendency to form an easily peelable surface particularly when containing a brittle hydrocarbon resin, forms a coating having a strong tendency to break into pieces, creating so-called "dust" when the coated metal material is worked, e.g., by pressing and contraction into a crown cap, during transportation of the cap, and stoppering or roll-on during bottling. These constitute drawbacks in terms of hygienics and commercial value, for which further improvements have been sought.

As far as we know, there is no paint having excellent wetting property between coatings, easily peelable adhesion, and freedom from "dusting" during opening.

Accordingly, it is an object of the present invention to provide an improved container closure in the form of an adhesive structure in which a pair of parts, at least one of which is made of metal, are bonded through a coating having excellent wettability between the coatings, easy peelability, adhesion and freedom from dust.

Another object is to provide an improved container closure in the form of an adhesive structure having peelability between the coatings, and whose wetting, peelable adhesiveness and dust-free properties are improved by an acid-denatured hydrocarbon resin.

Still another object of the invention is to provide a container cap with a peelable packing having excellent easy peelability of the packing and freedom from dust-formation upon separation.

These and other objects of the invention as well as a fuller understanding of the details and advantages thereof can be had by reference to the following disclosure and claims.

DISCLOSURE OF INVENTION

The foregoing objects are achieved according to the present invention by the discovery that when a pair of parts, at least one of which is made of metal, are joined and adhered together through a coating to form a cohesive structure whose peelable surface comprises a first layer of an acid-denatured hydrocarbon resin composition having an acid value in a certain range and second layer containing an epoxy resin, the above drawbacks of the prior art are substantially overcome.

Broadly, one aspect of the invention is a peelable adhesive structure comprising a pair of parts, at least one of which is made of metal, bonded together through a coating, which is characterized in that the peelable surface of the coating is formed between a first layer consisting of an acid-denatured hydrocarbon resin composition having an acid value between about 0.1 and 20, and a second layer containing an epoxy resin.

It is a feature of the invention that when an acid-denatured hydrocarbon resin composition having an acid value from about 0.1 to 20, and preferably from about 1.0 to 10.0 is used as a coating to form an "easily peelable adhesive surface" between an epoxy resin coating and the coated cap shell, the wetting property of both coatings is remarkably improved, thus providing excellent paint applicability without special care and making it possible to control the adhesion between the coating to a level characteristic of so-called easily peelable adhesion. Moreover, it is possible to completely prevent dust from being produced upon formation of cap shells from a coated metal sheet, and during transportation, closing and opening of caps.

As used herein, the term "easily peelable adhesive surface" means an interface between two resin layers bonded together to such an extent that peeling-off will not occur in normal handling, but when peeling is intended, it can be done easily with the fingers without need for an implement. In general, the peeling resistance of such an adhesive interface ranges from about 20 to 2000 g/cm, and preferably from about 50 to 1500 g/cm.

The critical feature of the acid-denatured hydrocarbon resin composition used in the peelable structure of the invention will be apparent from the examples described hereinbelow. In view of the data of Table 1, below, a coating consisting of an undenatured hydrocarbon resin has a poor wetting property and repels paint containing an epoxy resin, making it difficult to apply it as is. To permit application of the epoxy resin paint, it is necessary to add a wetting agent such as a saturated polyester resin to the paint. However, the addition of such a wetting agent results in an extremely weak bond between the coatings, e.g., below 0.01 kg/cm. In addition, such a composite paint produces a large amount of dust out of a coated metal sheet as shown in Tables 4 and 5 below. By contrast, with the acid-denatured hydrocarbon resin composition of the invention, the wetting ability the latter with respect the epoxy resin-containing paint is remarkably improved and the strength of adhesion between coatings falls within the aforementioned range of 20 to 2000 g/cm. Moreover, the amount of dust produced during working of the coated metal sheet is reduced.

It is also important that the acid-denatured hydrocarbon resin composition have an acid value of from 0.1 to 20, and preferably from 1.0 to 10. As shown in Table 2 below, acid-denatured hydrocarbon resin compositions having acid values below the above value have unsatisfactory wetting properties and adhesive strength; conversely, resin compositions having acid values above such range have adhesive strengths which are too large to form an easily peelable adhesive interface according to the invention.

Suitable acid-denatured hydrocarbon resin compositions include those obtained from the reaction of a hydrocarbon resin with an ethylenically unsaturated carboxylic acid or its anhydride, and partially esterified-denatured hydrocarbon resins obtained from the partial reaction between an acid-denatured hydrocarbon resin and an alcohol. The preferred hydrocarbon resin precursors include petrolem resins, cumarone-indene resins, and terpene resins, desirably those having softening points below about 180° C., and preferably below about 120° C. The petroleum resins are obtained by polymerization of unsaturated petroleum hydrocarbons such as a cyclopentadiene and a $C_9$ to $C_{11}$ olefin hydrocarbon by heating in the presence of a catalyst as is well known in the art. The known cumarone-indene resins of a lower polymerization degree are obtained by polymerization of tar fractions (generally from 160° to 180° C.) including mainly cumarone and indene. Suitable terpene resins include synthetic and natural terpene hydrocarbon polymers, preferably those obtained by polymerizing a turpentine oil or norpinene fraction in the presence of a catalyst.

Unsaturated carboxylic acids or anhydrides suitable for reaction with the hydrocarbon resins include acid monomers such as an acrylic acid, methacrylic acid, maleic acid, monomethyl maleate, fumaric acid, monoethyl fumarate, crotonic acid, itaconic acid, citraconic acid or 5-norbornene-2,3-dicarboxylic acid, and anhydride monomers such as maleic anhydride, citraconic anhydride, itaconic anhydride, 5-norbornene-2,3-dicarboxylic anhydride or tetrahydrophthalic anhydride. The foregoing monomers can be used alone or in combinations of two or more. For the acid monomer, an unsaturated fatty acid, such as oleic acid, linolenic and linoleic acid, or a fatty acid obtained from a drying oil such as cottonseed oil, linseed oil, safflower oil, soybean oil, dehydrated castor oil or tolu oil can be used. These acid or acid anhydride monomers can be used in combination with other monomers, such as ethyl acrylate, methyl methacrylate, 2-ethylhexyl acrylate, mono- or diethyl maleate, vinyl acetate, vinyl propionate, acrylamide, methacrylamide, maleic amide, acrolein, methacrolein, methylvinyl ketone, butylvinyl ketone, acrylonitrile, methacrylonitrile, gamma-hydroxypropylmethacrylate, beta-hydroxyethylacrylate, methylvinyl ether, glycidyl acrylate, ethylallyl ether, ethylvinyl ether, glycidyl methacrylate and glycidyl vinyl ether.

The amount of acid or acid anhydride monomer used is adjusted so that the acid-denatured hydrocarbon resin composition has a final acid value in the aforementioned range.

The acid or acid anhydride monomer and hydrocarbon resin can be reacted in the molten phase, solution phase, or in a solid-gas or solid-liquid heterogenous system. Addition or graft reaction between them can be thermally initiated, and in a molten system, the reaction may proceed sufficiently well without any catalyst. Naturally, a free radical initiator or the like can be used in conventional catalytic amounts and include organic particles, such as dicumyl peroxide, t-butylhydroperoxide, dibenzoyl peroxide and dilauroyl peroxide, or azonitriles such as an azobisisobutyronitrile, azobisisopropionitrile. Suitable radical initiation means include ionizing radiation, such as X-rays, gamma-rays and electron beams, ultraviolet rays or a combination thereof with a sensitizer, and mechanical radical starting means such as kneading and ultrasonic radiation. For example, in a homogenous solution system, a petroleum resin, a monomer and an initiator are dissolved in an aromatic solvent, such as toluene, xylene or tetralin, for grafting to form a precipitate of denatured hydrocarbon resin. For reaction in a heterogenous system, a hydrocarbon resin powder and a monomer or a solution of monomer are brought into contact under ionizing radiation for grafting. In a homogenous molten system, a hydrocarbon resin, a monomer, and, if necessary, a radical initiator agent are fused and kneaded in a stirring container, extruder or kneader to form an acid-denatured hydrocarbon resin composition. In any case, the acid-denatured hydrocarbon resin composition formed can be washed or extracted to remove unpolymerized monomer, homopolymer or residual starting materials.

The acid-denatured hydrocarbon resin composition thus obtained is partially reacted with an alcohol to form a partially ester-denatured hydrocarbon resin composition having an acid value in the above range for use in the invention. Suitable alcohols include monohydric alcohols such as a methanol, ethanol and propanol, and polyhydric alcohols such as ethylene glycol, propylene glycohol and glycerine. Esterification can be effected by any of the ways well-known to those skilled in the art. Alternatively, a hydrocarbon resin can be oxidized with oxygen or an oxygen-containing gas such as air to form an acid-denatured hydrocarbon resin composition. The oxidation can be accomplished, e.g., by blowing a gas into a solution of the resin. To the extent that the acid value of the final blend falls within the range defined above, the acid-denatured or partially denatured hydrocarbon resin composition thus obtained can be blended with an un-denatured hydrocarbon resin, if necessary, for the above purpose.

The acid-denatured olefin resin can be a resin denatured by adding or grafting the above acid or acid anhydride monomer to an olefin resin such as high-density polyethylene and isotactic polypropylene. The preferred starting olefin resin includes the foregoing, but a medium or low-density polyethylene and a crystalline ethylene-propylene copolymer can also be used. The adding or grafting conditions can be the same as those used for denatured resins, described hereinabove. Instead of an olefin resin denatured with an acid or acid anhydride, one can use a polyethylene oxide, or an acid radical-containing polyethylene obtained by oxidizing a polyethylene in the molten or liquid state with molecular oxygen or the like. Desirably, these acid-denatured olefin resins and polyethylene oxides (B) can be blended with a hydrocarbon resin (A) in the following weight ratio:

A:B=99.5:0.5 to 40:60, and preferably 98:2 to 50:50.

The above acid-denatured hydrocarbon resin or resin composition can be used alone to form the first coating, but if necessary or desired, it can be mixed with less than 20% by weight of a known coating base resin, such as a phenolic resin, amino resin, epoxy resin, alkyd resin, rosin, oleoresin, polyamide resins polyester resin and vinyl resin, to form the first coating.

The paint consisting of the acid-denatured hydrocarbon resin or resin composition of the invention has many advantages in manufacturing container caps in addition to the above properties. As stated above, the usual composite resin layer forming a peelable adhesive interface produces a large amount of dust while being worked into caps or while the caps are being handled. Consequently it is preferred to position the above composite resin coatings within the peripheral edge of the top plate of a container cap with a peelable packing or within the periphery of a liner or within the top section of a cap shell that is minimally worked to completely prevent dust production during pressing and contraction. During bulk shipment or preparative handling of the cap shells, the section in which the composite coatings are applied can be protected by the skirt of the shell, and when corked to a bottle mouth, it is completely protected by a liner so as to prevent production of dust. The acid-denatured hydrocarbon resin composition of the invention has a degree of adhesion appropriate for flatbed, relief, intaglio or screen printing, thus facilitating partial application of paint by printing. The acid-denatured hydrocarbon resin composition can be applied in the form of a liquid ink or paint, or a hot-melt ink or paint.

The epoxy resin forming the second coating includes a high-molecular weight polymer containing two or more epoxy groups in the molecule, its initial product or a combination thereof with a low- or high-molecular weight compound (hardener component) reactive with the epoxy group.

In general, the preferred epoxy resin can be obtained from condensation reaction between an epichlorohydrin and a polyvalent phenol. Such an epoxy resin has the following molecular structure:

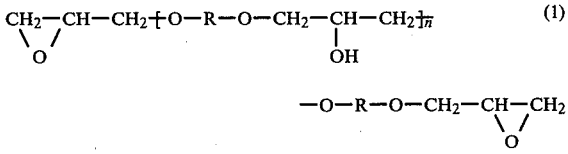

(1)

where n is zero or a positive integer, preferably no greater than about 12. R represents the hydrocarbon residue of the polyvalent phenol.

Divalent phenols (HO—R—OH) suitable for use in the present invention include polycyclic phenols such as 2,2-bis-(4-hydroxyphenyl)propane ("bisphenol A"), 2,2-bis-(4-hydroxyphenyl)butane ("bisphenol B"), 1,1-bis-(4-hydroxyphenyl)ethane, and bis-(4-hydroxyphenyl)methane ("bisphenol F"). Preferably, bis-phenol A is used, but an initial condensate between a phenol and formaldehyde can be used as a polyvalent phenol component. The preferred epoxy equivalent of an epoxy resin used as a resin component in the invention ranges from 140 to 4000, and preferably from 200 to 2500.

Hardeners suitable for use in conjunction with the epoxy resin component include polyfunctional compounds reactive with the epoxy group, such as polybasic acids, acidic anhydrides, polyamines, and polyamides. Examples of preferred polyfunctional components are ethylene diamine, diethylene triamine, triethylene tetramine, meta-phenylene diamine, 4,4'-diaminodiphenyl sulfone, 4,4'-diaminodiphenyl ether, polyamide dimerate, hydrazide adipate, oxalic acid, phthalic anhydride, maleic anhydride, hexahydrophthalic anhydride, pyromellitic dianhydride, cyclopentanediene methyl maleate, dodecylsuccinic anhydride, dichloromaleic anhydride and chlorendic anhydride. The preferred amount of hardener used ranges from about 2 to 150 parts by weight, and preferably from about 20 to 60 parts by weight per 100 parts by weight of the epoxy resin ingredient. (Hereinafter, ratios, parts and percentages are by weight unless otherwise indicated).

In preferred embodiments of the invention, the above epoxy resin ingredient is mixed with at least one thermosetting resin of the group consisting of cresol-type phenol-formaldehyde resins, urea-formaldehyde resins and melamine-formaldehyde resins to form the second coating layer. The ratio of these ingredients generally ranges from about 5:95 to 95:5, and preferably from about 40:60 to 90:10. The epoxy resin ingredient and the above thermosetting resin can be mixed or preliminarily condensed for use in forming the second coating layer.

A copolymer of a vinyl monomer (a), preferably vinyl chloride, and at least one other ethylenically unsaturated monomer (b) such as vinyl acetate, acrylic acid, methacrylic acid, maleic acid, fumaric acid, itaconic acid, alkyl acrylate ester, alkyl methacrylate ester, and vinylidene chloride is preferably used to form the protective base coating layer owing to its good workability and corrosion resistance. The preferred molar ratio of the vinyl chloride (a) to the other unsaturated monomer (b) generally ranges from about 95/5 to 60/40, and preferably from about 90/10 to 70/30. The molecular weight of the vinyl resin should be such that the latter is capable of forming a film.

Examples of suitable vinyl resins are vinyl chloride/vinyl acetate copolymers, vinyl chloride/vinyl acetate copolymers partially saponified, vinyl chloride/vinyl acetate copolymers partially saponified and partially acetal-formed, vinyl chloride/vinyl acetate/maleic anhydride copolymer and vinyl chloride/vinylidene chloride/acrylic acid copolymers. In addition, an epoxy resin, amino resin, phenolic resin, acrylic resin, or vinyl butylal resin can be used alone or in combination with the above vinyl resins.

A synthetic resin having appropriate cushioning and sealing properties, e.g., olefin resins such as polyethylene, ethylene-vinyl acetate copolymers, and ethylene-propylene copolymers, and soft vinyl chloride resins is preferred for use in forming the aforementioned packing.

The adhesive coating between the second coating layer and the packing can be made of acid-denatured olefin resins or paints containing a polyethylene oxide for use with an olefin resin packing, and of the above vinyl or acrylic resin paint for use with a vinyl chloride resin packing.

Methods for forming the packing include a method comprising extruding thermosetting resin into the shell of a cap, and pressing it for forming a packing shape and making thermal bond, and a method of supplying a fluid composition such as plastisol into the shell and applying a centrifugal force thereto to make extension and formation. Alternatively, a pre-formed disc packing made of thermosetting resin can be bonded to the top plate of a shell.

The metal base can be made of steel, copper, aluminum, zinc, stainless steel, nickel, brass, duralumin or dicast, or alloy. The metal base can also be made of steel plated with zinc, tin, chromium or aluminum, or treated with phosphate, chromic acid or electrolytic chromic acid. The metal can have any shape such as foil, rolled thin plate, panel, sheet, pipe, bar, section such as a beam, wire, stranded wire, can or other containers, architectural structure and vehicle structure.

The second part to be bonded to the metal base can be a film, sheet or other shape of plastic or rubber, a variety of papers, or their laminated composites.

While the adhesive structure of the invention is particularly useful for making container caps with peelable packings, it is also applicable to other uses such as temporary seals between a pair of parts and peelable protective coatings over an article.

BRIEF DESCRIPTION OF THE DRAWINGS

The present invention will now be further described in the context of the preferred embodiment depicted in the accompanying drawings, wherein.

DESCRIPTION OF PREFERRED EMBODIMENTS

Figure 1:
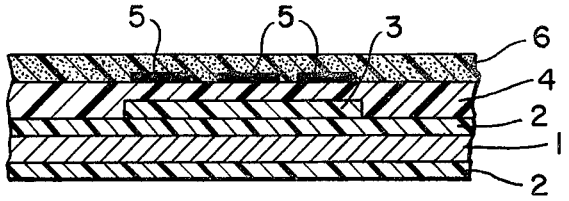
FIG. 1 is an enlarged section of a coated metal plate to be used for forming an adhesive structure.

Referring to FIG. 1, a pair of conventional protective paint films or coatings 2 are formed on both surfaces of a metal base 1 made of tinned steel or tin-free steel (steel electrolyzed with chromic acid). A first layer 3 made of acid-denatured hydrocarbon resin composition is applied to a portion of the surface of the coated metal plate to which a liner is to be provided. Preferably, layer 3 is of such a shape and size that it can be placed within the peripheral edge of the top plate of a cap shell or within the periphery of a liner. Second layer 4 containing an epoxy resin is provided over the entire surface of first layer 3. A printing ink layer 5 is applied on epoxy resin layer 4 in a pattern corresponding to the partial coating layer 3 for indicating a mark such as a prize. An adhesive paint layer 6 is provided over ink layer 5.

Figure 2:
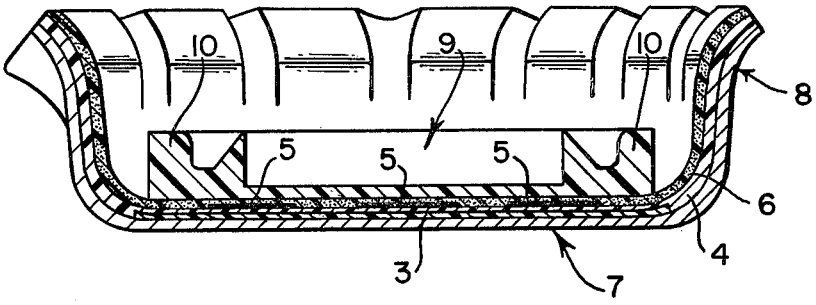
FIG. 2 is a sectional view of the adhesive structure of FIG. 1 shaped in the form of a crown cap with a packing.

In FIG. 2 there is depicted the composite structure of FIG. 1 after having been "punched" into a shape having a circular top plate 7 and a corrugated skirt 8. Preferably, the partial coating 3 of acid-denatured hydrocarbon resin composition is positioned within the peripheral edge of top plate 7 to prevent completely the creation of dust upon separation. A packing 9 made of synthetic resin is adhered to top plate 7 of the cap shell through the adhesive coating 6. Packing 9 can have a thickened portion 10 adapted for sealing the mouth of a container, e.g., a bottle (not shown).

When the packing is to be peeled off in the preferred embodiment, pressure is applied to the periphery of the packing with a finger or a device to initiate peeling between the partial coating 3 of acid-denatured hydrocarbon resin and the epoxy resin coating 4, and then break the coatings 4 and 6 in this section. Thereafter, peeling readily proceeds between the coatings 3 and 4 so that the packing 9 can be peeled off from top plate 7 along with printing ink layer 5.

Figure 3:
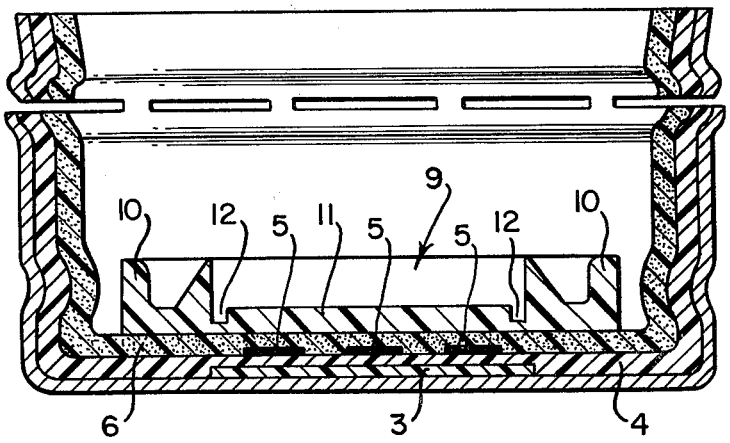
FIG. 3 is a sectional view of the adhesive structure shaped in a crown cap with a packing.

The peelable adhesive structure of the invention can be formed into a cap with a packing, as illustrated in FIG. 3. The packing 9 consists of a thickened seal member 10 and a thinned central section 11, with a recessed or breakably weakened line 12 provided between them, thus making it possible to peel only the central section 11, thereby permitting the cap to retain its resealability after the packing is peeled off.

In the preferred embodiment, the partial coating 3 made of acid-denatured hydrocarbon resin can be placed so as to correspond to the entire surface of the packing, or can be limited to portions from which peeling of the packing commences.

The following non-limiting examples will further illustrate the properties and advantages of the structure according to the invention.

EXAMPLE 1

While 500 g of a fatty acid hydrocarbon resin (TAKKIROL 1000 made by Sumitomo Chemical Company; softening point: 100° C.; average molecular weight: 1200; hue: 7; and acid value: 0.04) is melted and stirred, 3 g of maleic anhydride is added thereto and reacted for 90 minutes. The acid-denatured hydrocarbon resin obtained has a softening point of 100° C., a hue of 7 and an acid value of 5.0. The resin is dissolved in kerosene to form a 50% solution (Paint A).

While 500 g of an alicyclic hydrocarbon resin (ECR-4 made by Exxon Chemical Co.; softening point:

120° C.; and acid value: 0.3) is melted and stirred, 2 g of acrylic acid is added thereto and reacted for 2 hours at the same temperature. The acid-denatured hydrocarbon resin obtained has a softening point of 121° C. and an acid value of 4.3. This is dissolved in kerosene to form Paint B having a concentration of 50%.

A quantity (500 g) of a hydrogenated hydrocarbon resin (ESKOLETTS 5100 made by Exxon Chemical Co.; softening point: 105° C.; and acid value: 0.01) and 6 g of maleic anhydride are heated at 190° C. for 2 hours in the presence of 1 g of methylethyl ketone peroxide. After washing out excess maleic anhydride, the acid-denatured hydrocarbon resin obtained (softening point: 105° C. and acid value: 4.6) is melted at 200° C., to which 6 g of ethylene glycol is added for esterification at 200° C. for 2 hours. The esterified hydrocarbon resin obtained (softening point: 107° C. and acid value: 2.1) is dissolved in kerosene in the same manner as above form Paint C. A rust-preventive lacquer, i.e., vinyl paint (vinyl chloride-vinyl acetate copolymer VYHH UCC in methylethylketone (25% solution), is rolled over both sides of a 0.3-mm degreased tinplate sheet to form a dry coating having a thickness of 2 microns, and then heated at 180° C. for 10 minutes to form a coated sheet. Paints A, B and C are applied to one side of the coated sheet at a thickness of 4 microns, respectively, and heated at 180° C. for 10 minutes to form the first coating. Then, an epoxy-phenol paint (a 30% solution of EPICOAT #1007/PP-3005=80/20 containing equivalent amounts of xylene and butyl cellosolve) is applied to the first coating such that the dry film has a thickness of 5 microns. After a 0.1-mm aluminum foil is bonded to the coated surface, it is heated at 190° C. for 15 minutes to form an adhesive structure having an aluminum foil/-second coating/first coating/lacquer undercoat/tinplate sheet structure.

A structure having no first coating and a structure having the second coating formed of undenatured hydrocarbon resins of Paints A through C are formed for comparison. The peeling resistance between the aluminum foil and the tinplate sheet is measured for the 7 types of adhesive structures thus obtained, by means of the tension test by tensilone. The measurements are made at room temperature (20° C.) at a pulling rate of 50 mm/minute at a peeling angle of 180°. The results are listed in Table 1.

TABLE 1

| No. | First coating | Peeling resistance (kg/cm) | Remarks |
|---|---|---|---|
| 1 | Paint A | 0.26 | |
| 2 | Paint B | 0.33 | |
| 3 | Paint C | 0.41 | |
| 4 | Undenatured resin of A* | 0.01 or less | Poor wetting of the second coating. |
| 5 | Undenatured resin of B* | 0.01 or less | |
| 6 | Undenatured resin of C* | 0.01 or less | Al foil came off upon measurement. |
| 7 | None | Cut-off of Al foil | |

In each instance, peeling occurred between the first and the second coatings.
*Owing to poor wetting, 5 parts of saturated polyester was added to the paint to form the second coating.

EXAMPLE 2

A quantity (500 g) of the fatty acid hydrocarbon resin of Example 1 is melted at 200° C. Different amounts of maleic anhydride are added to the resin to form acidic hydrocarbon resins having various acid values. Each of the resins is dissolved in kerosene.

The first coating is made from acid-denatured hydrocarbon resins having varying amounts of denaturization to form an aluminum foil-tinplate sheet adhesive structure in the manner of Example 1. The results of peeling resistance measured for the adhesive structures obtained are presented in Table 2.

EXAMPLE 3

An aromatic hydrocarbon resin (PETROJIN #120 made by Mitsui Petrochemical Industries; softening point: 120° C.; average molecular weight: 870; acid value: 0.10) is dissolved in SOLVESSO #100 solvent to prepare Sample Solution D having a concentration of 50% by weight. The following four solutions are prepared as an additive:

1. A polyethylene oxide (density: 1.0; softening point 135° C.; carbonyl content: 35 meq/100 g) is dissolved in xylene at 120° C. to prepare a 20% solution.
2. A polyolefin denatured with maleic anhydride is dissolved in hot xylene to prepare a 20% solution.
3. Air is blown into dehydrated linseed oil (500 g) at 120° C. for 7 hours to form a linseed-type boiled oil an acid value of 2.0.
4. A quantity (100 g) of a vinyl chloride-vinyl acetate copolymer (VYHH) was dissolved in 400 g of an 80/20 mixture of cyclohexanone and xylene.

TABLE 2

| Sample No. | Amount of maleic anhydride used (%) | Acid value | Peeling resist. (kg/cm) | Remarks |
|---|---|---|---|---|
| 1 | 0.01 | 0.3 | 0.08 | |
| 2 | 0.1 | 1.2 | 0.32 | |
| 3 | 0.5 | 2.4 | 0.51 | |
| 4 | 1.0 | 5.1 | 0.47 | |
| 5 | 5.0 | 23.0 | 3.20 | |
| 6 | Undenatured | 0.04 | 0.01 or less | Poor wetting of the second layer. |

In each instance, peeling occurred between the first and the second coatings.
*To improve wetting, 5 parts of saturated polyester is added.

Solutions 1 through 4 are added to Solution D in amounts such that the solid component of each solution is 5 parts, and the solutions are stirred sufficiently to form hydrocarbon resin compositions having various resins added. A phenol-denatured alkyd resin undercoating agent, (PHTHALUKIDE Z414 made by Hitachi Kasei), is applied to a 0.23-mm pre-surface treated steel plate to a cured coating thickness of 2 microns, and then dried by heating at 180° C. for 10 minutes. The above hydrocarbon resin compositions 1 through 4 are rolled on the undercoat to a cured coating thickeness of 3 microns, and then heated at 180° C. for 10 minutes for forming the first coating.

A polyethylene oxide (density: 1.1 and softening point: 132° C.)-added epoxy-urea paint (a solution of 30%-by weight of a mixture of EPICOAT #1007 and butylated urea (P-138 made by Nippon Reichhold) and polyethylene oxide in the ratio of 80/20/15 dissolved in a mixture of ethyl cellosolve and n-butanol) is rolled to a dry coating thickness of 3 microns, and then hardened by baking at 190° C. for 10 minutes to form the second coating.

A 0.2-mm sheet of low-density polyethylene (SUMIKASEN LK-30) ws placed on the second coating, and pressed at 140° C. for 30 seconds by a hot press to form an adhesive structure with a TFS-undecoat-first coating-second coating-polyethylene structure.

The peeling resistance between the polyethylene and the metal of the thus-obtained adhesive structure is measured and the results are presented in Table 3.

TABLE 3

| Sample | Resin added | Peeling resist. (kg/cm) | Remarks |
|---|---|---|---|
| 1 | Polyethylene oxide | 0.41 | |
| 2 | Maleic anhydride-denatured polyethylene | 0.26 | |
| 3 | Linseed oil-type boiled oil | 0.34 | |
| 4 | Vinyl chloride-vinyl acetate | 0.03<br>0.03 | |
| 5 | No additive | 0.01 or less | Poor wetting owing to poor dispersibility |

In every instance peeling occurred between the first and second coatings.

EXAMPLE 4

A base coat (epoxy-amino paint), print and an overcoat (epoxy ester paint) are formed on one side (the outer surface of a crown cap) of a 0.23-mm surface-treated steel plate. A rust-preventing undercoating of vinyl lacquer identical with that of Example 1 is then applied on the outer surface (the inner surface of a crown cap) at a thickness of 3 microns.

Each of the acid-denatured hydrocarbon resin solutions Nos. 1 through 4 used in Example 1, the maleic anhydride-denatured hydrocarbon resin solution No. 3 used in Example 2 and the resin-added hydrocarbon resin solutions Nos. 1 through 5 used in Example 3 are applied on the above rust preventive undercoating and dried at 150° C. for 10 minutes to form the first coating. An epoxy-urea paint (a solution of 30%-by weight of a mixture of PICOAT #1009, SUPERBEKKAMIN P-138 in the ratio of 80/20 dissolved in a mixture of equal amounts of xylene and butyl cellosolve) is applied on the obtained first coating so that the thickness of a dry coating would be 3 microns, and then baked at 190° C. for 15 minutes to form the second coating.

A commercially available alkyd ink is applied on the second coating to form a prize print designed to have a picture and/or letters within a circle having a diameter of 26 mm, and then dried. The polyethylene oxide-added epoxy-urea paint used in Example 3 is applied as an adhesive on the above partially printed, second coating in such a manner that the thickness of a dry coating would be 5 microns, and baked at 190° C. for 10 minutes.

The thus-formed coated metal plate has a multi-layer structure with the first coating having a different composition. In addition, a coated plate without the first coating is formed for comparison. The obtained coated plate is formed into a crown cap shell of 26.6-mm inner diameter (the fifth class crown size in JIS S. 9017) by a press in such a manner that the center of the prize print can be positioned at the center of the top plate of the crown cap. A quantity (about 0.5 g) of low-density polyethylene having a density of 0.92 and a melt index of 7.0 is extruded by a conventional extruder (diameter: 20 mm and L/D: 10) into the above shell cap, and immediately punched with a cooling metal punch to form a crown cap having a polyethylene liner therein. The polyethylene liner is peeled off of the crown cap to measure the peeling resistance by a tension testing machine. Other characteristics required for the cap shell (workability such as punching and bending, linerholdability in the processes of transportation and stoppering and the amount of dust produced) are also evaluated, and the results are presented in Table 4.

EXAMPLE 5

In the same manner as Example 4, after the first coating, the second coating and the prize print are formed on one of the treated steel surfaces (the inner surface of a crown cap), a 20% -by weight solution of a vinyl chloride-vinyl acetate copolymer (made by VMCH UCC) dissolved in methylethyl ketone is rolled over the entire surface so as to form a 5-micron dry coating, and heated at 180° C. for 10 minutes to form a multi-layer coated metal plate.

TABLE 4

| Sample (2nd Coat) | Peeling resist. (kg/cm) | Work-ability | Liner hold | Amount of dust produced (mg) | Remarks |
|---|---|---|---|---|---|
| No. 1 in Ex. 1 | 0.38 | 0 | 0 | 10 | |
| No. 2 in Ex. 1 | 0.51 | 0 | 0 | 3 | |
| No. 3 in Ex. 1 | 0.44 | 0 | 0 | 5 | |
| No. 2 in Ex. 2 | 0.42 | 0 | 0 | 8 | |
| No. 1 in Ex. 3 | 0.44 | 0 | 0 | 7 | |
| No. 2 in Ex. 3 | 0.31 | 0 | 0 | 11 | |
| No. 3 in Ex. 3 | 0.36 | 0 | 0 | 9 | |
| No. 4 in Ex. 3 | 0.03 | x | v - x | 270 | Many liners came off during transportation. |
| No. 5 in Ex. 3 | 0.01 | x | x | 350 | Many liners came off during transportation. |
| No. 2nd coat | 4.0 or more | 0 | 0 | 3 | Peeling was impossible owing to liner break. |

In every instance, peeling occurred between the first and the second coatings. The prize print is transferred to the liner side.

TABLE 5

| Sample (2nd Coat) | Peeling resist. (kg/cm) | Work-ability | Liner hold | Amount of dust produced (mg) | Remarks |
|---|---|---|---|---|---|
| 1 No. 1 in Ex. 1 | 0.40 | 0 | 0 | 5 | |
| 2 No. 2 in Ex. 1 | 0.61 | 0 | 0 | 1 | |
| 3 No. 3 in Ex. 1 | 0.53 | 0 | 0 | 3 | |
| 4 No. 2 in Ex. 2 | 0.51 | 0 | 0 | 7 | |
| 5 No. 1 in Ex. 3 | 0.43 | 0 | 0 | 7 | |
| 6 No. 2 in Ex. 3 | 0.50 | 0 | 0 | 6 | |
| 7 No. 3 in Ex. 3 | 0.58 | 0 | 0 | 4 | |
| 8 No. 4 in Ex. 3 | 0.15 | x | v | 253 | Many liners came off during transportation. |
| 9 No. 5 in Ex. 3 | 0.02 | x | x | 312 | Many liners came off during transportation. |
| 10 No. 2 | 4.0 or more | 0 | 0 | 2 | Peeling was impossible owing to liner break. |

The coated plate is formed into a crown cap shell in the manner of Example 4. A quantity (0.5 g) of melted vinyl chloride resin having a softening point of 85° C. is extruded into the inside of the cap sheell and punched with a metal plate to form a crown cap having therein a vinyl chloride liner.

The peeling resistance and other characteristics of the crown cap with a vinyl chloride liner are assessed in the same manner as that of Example 4 and the results are presented in Table 5.

All the peeling interfaces are between the first and the second coatings of the peeled samples. The printed prize indication is transferred to the peeled-off liner.

The foregoing examples are presented for the purpose of illustrating, without limitation, the peelable adhesive structure of the invention. It is understood, of course, that changes and variations can be made in the foregoing without departing from the scope of the invention as defined in the following claims.

We claim:

1. A peelable adhesive structure comprising a plurality of parts, at least one of which is made of metal, adhering together by means of a coating, chracterized in that said coating has a peelable surface formed between a first layer of an acid-denatured hydrocarbon resin composition having an acid value of from 0.1 to 20 and a second layer containing an epoxy resin, said denatured hydrocarbon resin being obtained from the reaction between (A) a hydrocarbon resin precursor selected from the group consisting of (i) petroleum resins which are obtained by polymerization of cyclopentadiene or $C_9$ to $C_{11}$ olefin hydrocarbons, (ii) cumarone-indene resins and (iii) terpene resins, and (B) an ethylenically unsaturated carboxylic acid or its anhydride.

2. The adhesive structure according to claim 1, wherein the epoxy resin is a resin composition containing (C) an epoxy resin and (D) a resin selected from the group consisting of a cresol-type phenol-formaldehyde resin, urea-formaldehyde resin and melamine formaldehyde resin in the following ratio by weight:

$$C:D=5:95 \text{ to } 95:5.$$

3. The structure according to claim 1, wherein the first and second layers have a peeling resistance of from 0.02 to 2 kg/cm.

4. The structure according to claim 1, wherein the metal part is a cap shell, and said other part is a packing made of resin or rubber.

5. The structure according to claim 4, wherein said first layer is placed on the side of the cap shell, and said second layer is placed on the side of the packing.

6. The structure according to claim 5, which further comprises an undercoat of vinyl resin paint provided between the cap shell and the first layer.

7. The structure according to claim 5, wherein the packing is made of an olefin resin, said olefin resin packing itself forming the second layer, or bonded through an adhesive coating, which is a separate layer from the second layer, containing a polyethylene oxide or acid-denatured olefin resin.

8. The structure according to claim 5, wherein the packing is made of a vinyl chloride resin, with an adhesive coating containing a vinyl resin provided between the vinyl chloride resin packing and the second layer.

9. The structure according to claim 7 or 8, which further comprises an ink layer provided between the packing and the adhesive coating, or between the adhesive coating and the second layer for indicating a prize.

10. A structure according to claim 4, wherein said first layer made of said denatured hydrocarbon resin or denatured hydrocarbon resin composition is provided by printing.

* * * * *

UNITED STATES PATENT AND TRADEMARK OFFICE

CERTIFICATE OF CORRECTION

PATENT NO. : 4,395,446

DATED : July 26, 1983

INVENTOR(S) : Kunimoto et al.

It is certified that error appears in the above-identified patent and that said Letters Patent are hereby corrected as shown below:

Column 1, line 13, "coposite" should read --composite--.

Column 3, line 34, "ability the latter with respect the" should read --ability of the latter with respect to the--.

Column 4, line 41, "particles" should read --peroxides--.

Signed and Sealed this

*Twenty-seventh* Day of *September 1983*

[SEAL]

*Attest:*

GERALD J. MOSSINGHOFF

*Attesting Officer*

*Commissioner of Patents and Trademarks*